US005884641A

United States Patent [19]

Berg

[11] Patent Number: 5,884,641

[45] Date of Patent: Mar. 23, 1999

[54] DEVICE FOR A WASHING APPARATUS WHICH INFORMS WHETHER THE CONTENTS ARE CLEANED OR SOILED

[76] Inventor: Floyd L. Berg, 24391 Wagon Wheel La., Lake Elsinore, Calif. 92330

[21] Appl. No.: 617,127

[22] Filed: Mar. 18, 1996

[51] Int. Cl.[6] ..... A47L 15/42

[52] U.S. Cl. ..... 134/113; 116/229

[58] Field of Search ..... 134/113; 116/228, 116/229; 73/317; 137/558; 200/84 R, 84 B

[56] References Cited

U.S. PATENT DOCUMENTS

| | | | |
|---|---|---|---|
| 332,480 | 12/1885 | Boyle | 200/84 R |
| 792,237 | 6/1905 | Reeve | 200/84 R |
| 1,142,926 | 6/1915 | Wright et al. | 73/317 X |
| 1,304,195 | 5/1919 | Noeth | 137/558 X |
| 1,410,767 | 3/1922 | Schroeder | 137/558 X |
| 1,465,189 | 8/1923 | Stewart | 137/558 X |
| 2,744,411 | 5/1956 | Spencer | 116/229 X |
| 3,536,032 | 10/1970 | Ridding | 116/229 |
| 4,129,954 | 12/1978 | Hulteen | 134/113 X |
| 5,477,872 | 12/1995 | Berg | 134/113 X |

*Primary Examiner*—Philip R. Coe
*Attorney, Agent, or Firm*—Richard P. Berg; Ladas & Perry

[57] ABSTRACT

A signalling system for a washing device having at least one rack for holding articles during the washing of same and a door for gaining access to the articles. The signalling system includes a container which collects wash and/or rinse water and a floatable indicator which moves in relation to fluid filling the container. The indicator displays signals to the user of the washer to convey to the user whether the contents of the washer have been washed or are waiting to be washed.

12 Claims, 1 Drawing Sheet

DEVICE FOR A WASHING APPARATUS WHICH INFORMS WHETHER THE CONTENTS ARE CLEANED OR SOILED

TECHNICAL FIELD

This invention relates to a signalling system for an automatic dishwasher. This system informs a user whether the contents of the washer have been washed or are waiting to be washed. The signalling system provides a visual indication, so that the user of the washer is less likely to mistakenly load soiled articles into a dishwasher which contains washed articles, thus reducing the possibility of contaminating a clean load of articles with those needing to be washed.

BACKGROUND

The automatic dishwasher is widely used in homes and restaurants to clean and sanitize articles, for example tableware, dishes, flatware, pots, pans, etc. A dishwasher contains movable racks disposed in a cavity accessed via a watertight latchable door. A typical automatic dishwasher has two racks, each of which can move in and out of the cavity to facilitate unloading clean dishes from the racks and in loading soiled dishes in the racks. In use, the user opens the door, places the articles on the racks, adds detergent, latches the door, and initiates a cleaning cycle. The washer washes the articles with soapy water or other cleansing liquid, rinses the articles, optionally dries the articles and then holds them in the racks until removed. With the time pressures of modern society, the user of the automatic washer does not stand by for the dishwasher to complete it's cycle of washing and drying. Rather, the user attends to other matters while the articles are being washed. Indeed, it may be many hours (or even days) before the user returns to the dishwasher and opens the door. At that time the user may have forgotten that the articles inside are clean. Thus, the user (or another person) may mistakenly add newly soiled dishes to those that are clean and will realize, too late, that the dishes in the washer were clean. Now, the entire load of articles should be washed again to ensure that they are all clean. This results in aggravation, lost time and additional expense in hot water and soap. For the foregoing reasons there is a need for an easy-to-use signalling device to convey the wash status of articles disposed within a dishwasher.

SUMMARY

The present invention is directed to a device that satisfies this need. A signalling device having the features of the present invention comprises a fluid container and a floatable indicator engaged with the container. The indicator signals the presence or absence of fluid within the container.

DRAWINGS

Figure 1:
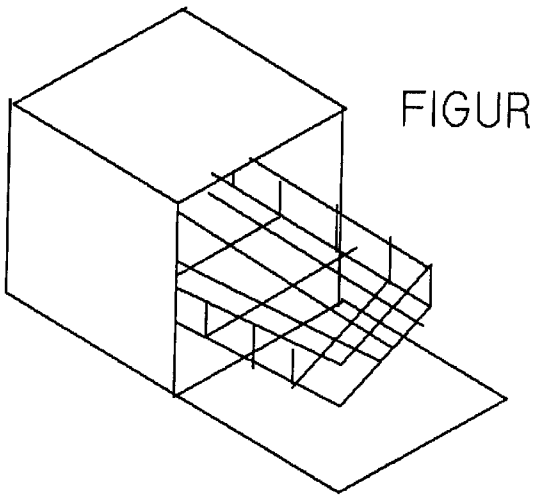
Figure 2:
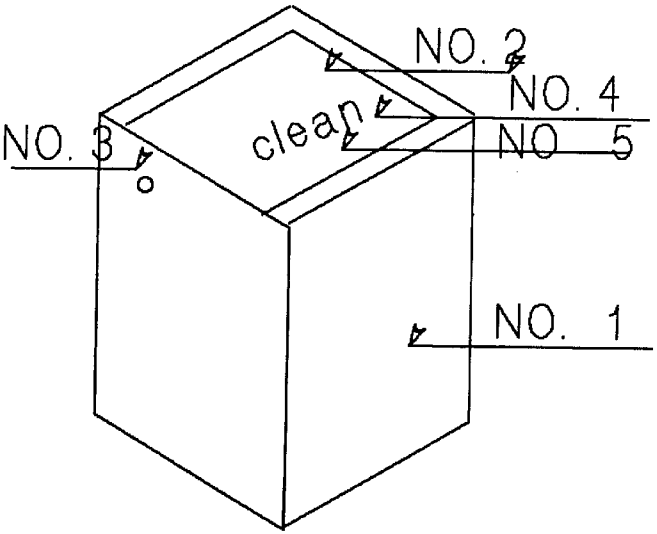
Figure 3:
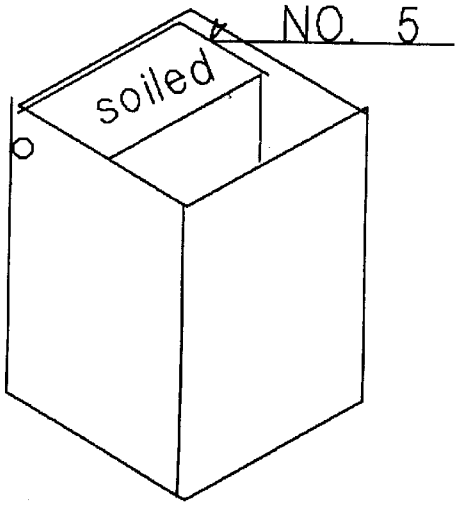

These and other features, aspects, and advantages of the present invention will become better understood with regard to the following description, appended claims and accompanying drawings where:

FIG. 1 shows an embodiment of the signalling device (1) with the position of floatable indicator (4) indicating that the device is empty of fluid as it would be when the articles in a washer have not yet been washed;

FIG. 2 shows an embodiment of the signalling device (1) with the position of floatable indicator (4) indicating that the device is full of fluid as it would be when the articles in a washer have been washed; and FIG. 3 shows a cutaway view of an embodiment of the device showing stop (11) and floatable indicator (4) with the position of floatable indicator (4) indicating that the device is empty of fluid as it would be when the articles in a washer have not yet been washed.

DESCRIPTION

A desired object of the present invention is to provide a visual indication as to whether the articles disposed on the racks in the dishwasher are dean or soiled thereby decreasing the likelihood that a user will mistakenly load soiled articles with previously cleaned articles which are still disposed on the racks in a dishwasher.

This objective is achieved as is now described. The present invention is a signalling device which collects a small amount of the washing solution used by a dishwasher during a wash cycle; the presence or absence of this small amount of fluid provides a visual indication of the clean or soiled status of the articles in the dishwasher. An embodiment of this invention has a floatable indicator which has two indicating positions to indicate to a user whether the articles in the dishwasher are clean or soiled. The indicator preferably provides indicia, the more easily observable indicia on the floatable indicator when the floatable indicator is "floating" on the washing solution contained within an embodiment of the invention indicates to a user of the dishwasher that the articles inside the dishwasher are clean. When the user unloads the clean dishes from a dishwasher after the washer has completed it's wash cycle, the user resets the signalling device by removing fluid from within the device and replacing the device within the dishwasher. When the device contains little or no solution (so that the larger surface 5 of floatable indicator 4 is resting against stop 11) the more easily observable indicia on the floatable indicator indicate to a user of a dishwasher that the articles disposed on the racks within a dishwasher are soiled. The floatable indicator could, in other ways, indicate wash status signals to a user, such as the floatable indicator having different colors on the two legs of the L-shaped floatable indicator or just by having the two legs of the indicator of different size. Although the figures depict a cubic container, the shape depicted should not be viewed as a restriction on the shape of this invention as almost any shape that will hold fluid will work.

In the preferred embodiment the device is made from a dishwasher-safe plastic and is comprised of a base 8 and four sides 9, two of the four sides containing an engagement point 10, one of said four sides having a stop 11 attached. An edge perimeter 3 of said device 1 defines a portal 2, said portal 2 receiving fluid entering the device. The perimeter 3 is deposed in an upward direction when the device is in use. When the device is placed in a washer with the perimeter 3 disposed upwardly, washing and rinsing liquids, which are sprayed inside the washer during the wash and rinse cycles, enter the device through the portal and fill the interior of the device with fluid. A floatable indicator 4, is pivotally mounted on two of the four sides 9 at said engagement points 10 so as to allow said indicator to pivot through an arc. The floatable indicator preferably has a larger surface 5 and a smaller surface 6 and is preferably made from a dishwasher-safe plastic material. The material selected for the indicator should be less dense than water so that it will tend to float on the water which fills the device. The larger surface 5 and the smaller surface 6 meet at pivotal axis A. As shown in FIG. 1, when the device 1 contains little or no fluid and is oriented with its portal arranged in an upwardly direction, the greater weight of larger surface 5 (in comparison to that of smaller surface 6) causes larger surface 5 to hang in a downward direction with the larger surface 5 resting against stop 11. In the hanging orientation of larger surface 5, smaller surface 6 is disposed in an indicating position where it can be easily recognized by the user. In the disclosed embodiment, smaller surface 6 partially covers the portal 2 of the device. When fluid begins to enter the interior of the device through portal 2, the larger surface 5 will begin to float on the fluid. As fluid fills the device, indicator 4 will pivot on axis A with the edge 7 of its larger surface 5 moving toward the perimeter 3 such that when the device 1 is full of fluid, larger surface 5 will be disposed more or less parallel to the base 9 as is shown in FIG. 2. This pivotal movement allows other different indicia which will be displayed to the user to convey the wash status of the articles in the washer. The preferred embodiment of the wash status is displayed by indicia (colors, size, letters, words, etc.) on the surfaces of the floatable indicator. The different sizes of the surfaces 5,6 can alone provide the status information to the user.

FIG. 3 shows how the stop 11 preferably limits the movement of the floatable indicator 4 towards the rear surface 9 so that the movement does not go beyond the perpendicular with respect to base 8. This helps ensure that the indicator will rotate to the position shown in FIG. 2 as the device fills with water. The sides 9 and bottom, for that matter, may be made of a transparent material so liquid may be readily seen inside the device.

It is to be understood that the above described embodiments of the invention are merely illustrative of the principles thereof and that numerous modifications and embodiments of the invention may be derived within the spirit and scope thereof.

I claim:

1. A device comprising a fluid container having a open end and a floatable indicator disposed in said fluid container, said floatable indicator having a relatively larger first surface and a relatively smaller second surface, the second surface facing said open end when said container is free of fluid and the first surface facing said open end when said container fills with fluid.

2. The device of claim 1 wherein said first and second surfaces are observationally distinguishable from each other.

3. The device of claim 2 wherein said floatable indicator is rotationally mounted to said container adjacent its open end, said floatable indicator moving in response to said container filling with fluid causing said first surface of said indicator to be the more easily observable by an observer.

4. A combination comprising a dishwashing apparatus and device having at least one side, a base, a perimeter edge defining a portal and a floatable indicator, said indicator being rotatable relative to the base, said indicator rotating when fluid fills the interior of said device via said portal, said device being disposed in said dishwashing apparatus and wherein the fluid is water dispensed by said dishwashing apparatus.

5. A device comprising at least one side, a base, a perimeter edge defining a portal and a floatable indicator, said indicator having a relatively larger first surface and a relatively smaller second surface, the second surface facing said portal when said device is free of fluid and the first surface facing said portal when said device fills with fluid.

6. The device of claim 5 wherein said container has four side walls each of which joins said base, two of said side walls having an engagement point, said floatable indicator being pivotally engaged at said engagement points of said two of said walls.

7. The device of claim 5 wherein a more easily observable surface of said indicator when said device contains fluid is different from a more easily observable surface of said indicator when said device contains no fluid.

8. The device of claim 5 wherein said indicator rotates about an axis disposed essentially parallel to said base as said device fills with fluid.

9. The device of claim 5 wherein said indicator is mounted for rotational movement relative to a wall of said device, and wherein, in response to fluid rising in said device, the indicator moves from a position adjacent said wall to a position extending away from said wall.

10. The device of claim 5 wherein said indicator has at least a major axis and is mounted for rotational movement relative to a wall of said device, and wherein, in response to fluid rising in said device, the major axis of the floatable indicator moves from a position adjacent said wall to a position extending away from said wall.

11. The device of claim 5 wherein said indicator is rotatably mounted relative to the base, said indicator rotating when fluid fills the interior of said device via said portal such that the first surface rotates towards said portal as said device fills with fluid.

12. The device of claim 1 wherein said indicator indicates the presence of fluid within said container, said indicator being mounted to said container for rotational movement so that said indicator rotates into a position in said open end in response to said indicator floating on the fluid as the fluid fills said container and rotates away from said open end and into a position adjacent a wall of said container in response to said container being emptied of fluid.

* * * * *